US005604068A

United States Patent [19]

Miyamoto et al.

[11] Patent Number: 5,604,068

[45] Date of Patent: Feb. 18, 1997

[54] ELECTRONOGRAPH DEVELOPING AGENT AND METHOD OF MANUFACTURING THE SAME

[75] Inventors: Etsuko Miyamoto, Yamato; Hiroshi Murata; Eiichi Kaga, both of Yokohama, all of Japan

[73] Assignee: Kabushiki Kaisha Toshiba, Kawasaki, Japan

[21] Appl. No.: 111,062

[22] Filed: Aug. 24, 1993

[30] Foreign Application Priority Data

| | | | |
|---|---|---|---|
| Aug. 24, 1992 | [JP] | Japan | 4-224128 |
| Feb. 23, 1993 | [JP] | Japan | 5-056406 |
| Mar. 25, 1993 | [JP] | Japan | 5-067106 |
| Aug. 24, 1993 | [JP] | Japan | 5-229641 |

[51] Int. Cl.[6] ..... G03G 9/00; G03G 5/00

[52] U.S. Cl. ..... 430/109; 430/111; 430/137

[58] Field of Search ..... 430/104, 109, 430/111, 137, 125

[56] References Cited

U.S. PATENT DOCUMENTS

| | | | |
|---|---|---|---|
| 4,077,804 | 3/1978 | Vanzo | 96/1 SD |
| 4,794,065 | 12/1988 | Hedvall et al. | 430/111 |
| 5,080,992 | 1/1992 | Mori et al. | 430/137 X |
| 5,080,994 | 1/1992 | Breton et al. | 430/137 |
| 5,164,282 | 11/1992 | Mahabadi et al. | 430/109 |
| 5,252,421 | 10/1993 | Ichimura et al. | 430/111 X |
| 5,354,640 | 10/1994 | Kanbayashi et al. | 430/137 X |
| 5,418,108 | 5/1995 | Kmiecik-Lawrynowicz | 430/137 |

FOREIGN PATENT DOCUMENTS

| | | | |
|---|---|---|---|
| 0371811 | 6/1990 | European Pat. Off. . | |
| 0504942 | 9/1992 | European Pat. Off. | 430/109 |
| 59-61844 | 4/1984 | Japan . | |
| 63-186253 | 8/1988 | Japan . | |
| 2187768 | 7/1990 | Japan . | |
| 2192730 | 7/1987 | United Kingdom . | |

OTHER PUBLICATIONS

Yushina et al., JP 2–187768, Jul. 23, 1990 English Translation.

*Primary Examiner*—George F. Lesmes
*Assistant Examiner*—Bernard P. Codd
*Attorney, Agent, or Firm*—Foley & Lardner

[57] ABSTRACT

An electronograph developing agent containing polymerized particles of non-uniformly-shaped aggregated materials obtained by aggregated of colloidal oil drops, each having a developing-agent core made of a polymerized substantially spherical resin fine particle and a coloring agent adhered onto the resin fine particle by a static force, and a monomer for swelling the developing-agent core.

7 Claims, 5 Drawing Sheets

ELECTRONOGRAPH DEVELOPING AGENT AND METHOD OF MANUFACTURING THE SAME

BACKGROUND OF THE INVENTION

1. Field of the Invention

The present invention relates to a developing agent for an electronograph used for formation of an image by visualizing a static latent image of an electronographic mode or the like, and a method of manufacturing such a developing agent.

2. Description of the Related Art

In general, a developing agent is made by mixing magnetic powder, coloring agent, etc., into melted resin, and pulverizing the mixture resin by a pulverizing method including a clarification step. With such a conventional method, it is difficult to disperse the magnetic powder and the coloring agent uniformly into the resin, and the non-uniform dispersion causes the deterioration of an image. In place of the conventional pulverizing method, various types of methods of manufacturing a developing agent, such as the suspension polymerization method, emulsion polymerization method, and polymerization methods have been recently proposed. In the polymerization method, for example, a monomer, coloring agent, surfactant, and other additives are dispersed in an aqueous solution, and the mixture solution is stirred at a predetermined temperature, concentration and driving force, in order for a polymerization reaction, thereby obtaining toner. With this method, dispersion of the coloring agent particles can be performed to a certain degree.

However, thus obtained polymerization toner entails a drawback of insufficient cleaning since the particles of the toner has a sphere shape. In order to solve the drawback, there has been an attempt to make the particles of the toner non-uniformly shaped. The term "non-uniformly shaped" used here is meant to be not having a specific shape such as sphere, and the non-uniformly-shaped toner is meant to be a type containing particles of various shapes.

Such an non-uniformly-shaped toner can be prepared in the following steps as is disclosed in Published Unexamined Japanese Patent Application No. 2-187768.

(1) Formation of primary particles by polymerization

A monomer, a pre-polymerized resin emulsion, a coloring agent, an additive, and the like are dispersed or suspended in a solvent, and the mixture is stirred at a predetermined temperature, concentration and driving force for a polymerization reaction, thereby forming primary particles having particle diameters of 10 μm or less. FIG. 1 shows models of particles. As can be seen in FIG. 1, the primary particles have substantially a spherical shape.

(2) Formation of secondary particles by granulation

The primary particles are granulated by a general method so as to form secondary particles having particle diameters of 25 μm or less. As can be seen in FIG. 1, the secondary particles are aggregates having non-uniform shapes.

(3) Formation of associated particles by ripening

The primary particles constituting each secondary particle are fused with each other by heat, thereby obtaining non-uniformly-shaped associated particles as shown in FIG. 1.

The non-uniformly-shaped associated particles are subjected to a washing/removal-of-water/drying step, and a surface-treatment step, and then to a classification step, thus forming a non-uniformly-shaped toner having predetermined particle diameters.

In order to improve the cleaning property of this toner, the state of primary particles fused with each other may weakened by heat in the ripening step. With such a technique, there can be obtained a further non-uniformly-shaped toner having a high shape coefficient. However, if the fusion state of the primary particles is weak, the anti-crush property of the toner is degraded, causing drawbacks such as creation of fine particles and scattering of toner.

On the other hand, in order to improve the anti-crush property, the material may be heatear sufficiently in the ripening step so as to strengthen the fusion of primary particles with each other. However, as the material is heated, the particles of the toner become closer to perfect spheres, thus lowering the shape coefficient. As a result, its cleaning property decreases. With the conventional method, it is difficult to achieve non-uniformly-shaped toner excellent in both cleaning and anti-crush properties.

In each of the above steps of formation of the primary particles, granulation of the secondary particles, and formation of the associated particles by ripening, it is necessary to control the diameters of particles, and the distribution of the diameters, resulting in complication of the polymerization toner manufacture method. The dispersion property of the coloring agent in the polymerization toner is an important factor for enhancing the polymerization stability, the coloring ability, the transparency, which is necessary especially in color toner. For the dispersion step in polymerization of toner, there have been proposed various types of techniques for the purpose of enhancing the dispersion property of the coloring agent with respect to the monomer.

SUMMARY OF THE INVENTION

The purpose of the present invention is to provide a developing agent which can be easily prepared in simple steps, and has improved cleaning and anti-crush properties. Further, another purpose of the present invention is to improve the dispersion property of the coloring agent, the coloring ability of the polymerization toner, and the transparency, especially in color toner.

The first aspect of the invention is to provide a developing agent comprising: a non-uniformly-shaped polymerized particle which is derived from a plurality of aggregated colloidal oil drops; said oil drop comprises a developing agent core and a polymerized monomer for swelling said developing agent core.

The polymerization is carried out through substantially emulsification and suspension.

The second aspect of the invention is to provide a method of manufacturing a developing agent comprising the steps of: i) forming a developing-agent core by adhering a coloring agent electrostatically on the surface of a pre-polymerized substantially spherical resin fine particle; ii) forming a colloidal oil drop by swelling the developing-agent core with a monomer; iii) aggregating the colloidal oil drop into a non-uniformly-shaped aggregated material; and iv) polymerizing the non-uniformly-shaped aggregated material.

The third aspect of the invention is to provide a developing agent comprising a non-uniformly-shaped polymerized particle which is derived from a plurality of colloidal oil drops wherein the colloidal oil drops contain a first colloidal oil drop, having a first diameter, comprising a developing agent core and a first polymerized monomer for swelling the first developing agent core, and a second colloidal oil drop, having a second diameter larger than the first diameter, comprising plural developing agent cores and a second polymerized monomer for swelling the plural developing agent cores.

It is preferable that the developing agent according to the third aspect of the invention contain fine particles having diameters of 0.05 to 2 μm and substantially the same composition as that of the particle.

The fourth aspect of the invention is to provide a method of manufacturing a developing agent comprising the step of: i) forming a developing-agent core by adhering a coloring agent electrostatically on the surface of a pre-polymerized substantially spherical resin fine particle; ii) forming a first colloidal oil drop, having a first diameter by swelling the developing-agent core with a monomer; iii) forming a second colloidal oil drop, having a second diameter larger than the first diameter by colliding said first colloidal oil drops with each other; iv) aggregating a mixture of said first and second colloidal oil drops; v) forming a polymer particle having a projection or a recess by polymerizing the aggregated colloidal oil drops; and vi) classifying the polymer particles obtained in the polymerization step v).

It is preferable that in the developing agent according to the fourth aspect of the invention, the diameter of the first colloidal oil drop is 0.05 to 2 μm, and the first colloidal oil drop is mixed with the second colloidal oil drop at 0.5 to 10 wt % in step iv).

The developing agent of the present invention can be prepared by a method including the steps of forming a colloidal oil drop, aggregating the colloidal oil drop and polymerizing the aggregated material. The developing agent thus obtained contains coloring agent particles having a good dispersion property, and the developing agent itself has a good coloring ability, and a good transparency in the case where the developing agent is applied as color toner.

Further, the developing agent of the invention is a polymer of aggregated materials of colloidal oil drops containing developing agent components. The aggregated materials are integrally combined with each other not by fusion with heat but by chemical bonding with polymer chains generated by the polymerization. Consequently, the particles of the developing agent exhibit excellent non-uniform shapes as compared to those obtained by fusion. Further, the developing agent has a good cleaning property, and a strength against crush.

Along with the developing agent, developing agent fine particles having substantially the same composition are prepared in certain amount simultaneous with production of the developing agent so as to be utilized as a cleaning auxiliary.

Moreover, according to the present invention, colloidal oil drops are aggregated and polymerized, and therefore the production time period can be shortened as compared to the case where toner particles are granulated after polymerization, and fused by heat.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

According to the first aspect of the invention, there is provided a developing agent comprising: a non-uniformly-shaped polymerized particle which is derived from a plurality of aggregated colloidal oil drops; said oil drop comprises a developing agent core and a polymerized monomer for swelling said developing agent core. The developing agent core preferably comprises a polymerized spherical resin particle and a coloring agent adhered onto the resin particle by an electrostatic force.

Figure 2:
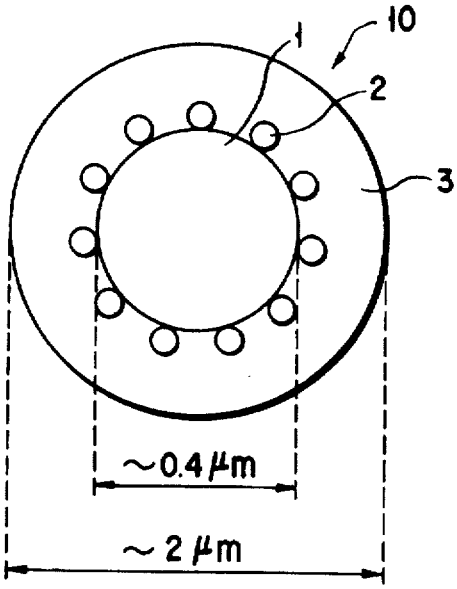
FIG. 2 is a schematic view of a colloidal particle used in the production of the developing agent according to the present invention.

FIG. 2 shows a particle model of the colloidal oil drop. As can be seen in FIG. 2, the colloidal oil drop has the following constitution. That is, coloring agents 2 are adhered on a resin fine particle 1 to make a developing-agent core, and the developing-agent core is swelled with a polymerized monomer 3. With such a constitution, the particle has a stable structure. Consequently, it is less likely that coloring agents will drop out of the core due to crushing of the colloidal oil drop during the polymerization. Further, the polymerization of the aggregated material proceeds easily.

In the developing agent of the present invention, the coloring agents 2 are adhered onto the substantially-spherical resin fine particle 1 almost uniformly by a static force, and therefore the dispersibility of the coloring agent in the developing agent is good. Such a developing agent is excellent in coloring ability, as well as transparency when used as color toner.

Further, the developing agent of the invention is a polymer of aggregated materials of colloidal oil drops containing components of the developing agent. The aggregated materials are integrally combined with each other not by fusion with heat but by chemical bonding with polymer chains generated by the polymerization. When an aggregated material of developing agent particles is fused by heat, it can be said that as the aggregated material is heated to fusion bond, the bonded material become closer to sphere-shaped. It is easily observed that the developing agent of the present invention involves non-uniformly shaped particles more suitable than those prepared by fusion. Further, the particles of the present invention are bonded chemically with each other, and therefore the strength against crushing is excellent.

Figure 1:
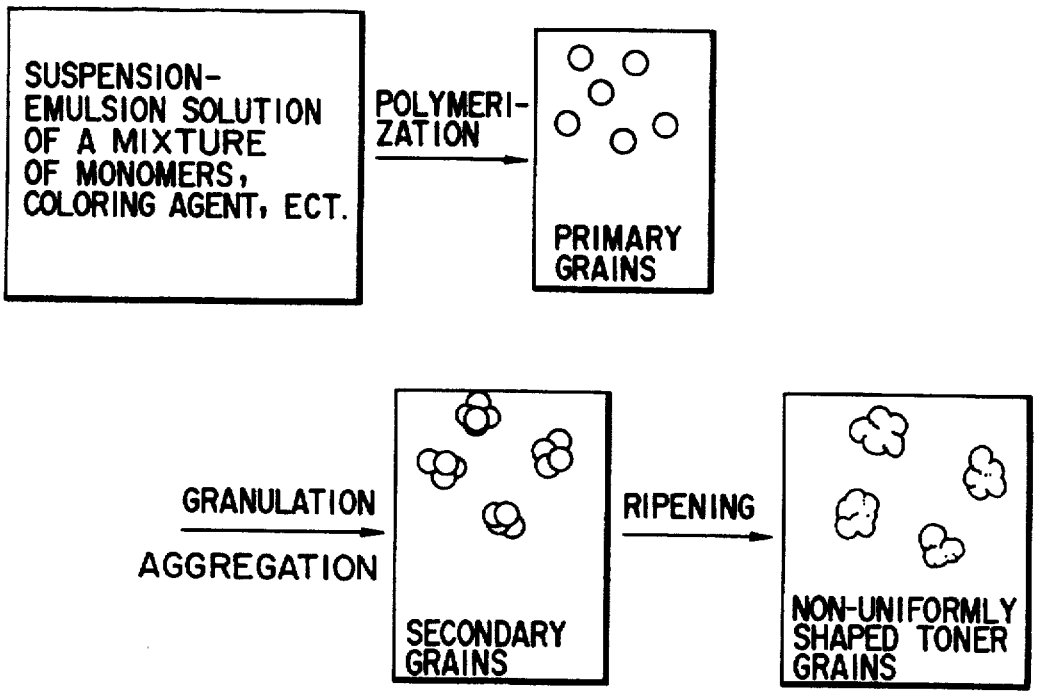
FIG. 1 PRIOR ART
FIG. 1 is a diagram showing the production steps of the conventional polymerization toner.

The developing agent made by polymerization of the aggregated colloidal particles (such as shown in FIG. 2) has a non-uniform particle shape and a high shape coefficient, as compared to the convention developing agent (FIG. 1) prepared by film-forming fusion using heat. Because of its high shape coefficient, the non-uniformly-shaped particle developing agent of the invention has a good cleaning property and an anti-crush property.

The non-uniformly-shaped particle of the invention should preferably have a volume average particle diameter of 0.5 to 10 μm, more preferably about 3 to 6 μm. If the volume average particle diameter is less than 0.5 μm, scattering of toner occurs, whereas if it exceeds 8 μm, excellent image can not be obtained.

A swelled colloidal oil drop should preferably have a volume average particle diameter of 0.5 to 2 μm. If the volume average particle diameter exceeds 2 μm, the number of colloidal oil drops is not sufficient to form aggregate having predetermined diameter, whereas if it is less than 0.5 μm, the amount of a monomer for swelling the developing-agent core is not sufficient to make aggregate.

The resin particle of the developing-agent core used in the present invention should preferably have a volume average particle diameter of about 0.4 μm or less, more preferably about 0.04 to 0.4 μm.

The pre-polymerized resin emulsion used in the invention is prepared by polymerization or copolymerization of monomers. If the volume average particle diameter of the resin particles of the developing-agent core is less than 0.4 μm, the coloring agents are adhered onto the surface of the resin emulsion, and therefore the coloring agent particles can be dispersed at distance of not more than 0.4 μm. As in the case of the hiding force, the coloring ability becomes high, as the particles become small. The hiding force exhibits its maximum value when the particle dispersion diameter is about ½ of the absorption wavelength of the coloring agent particles, and when less than ½, the transparency gets drastically high. In particular, since the absorption wavelength of the color pigment falls within a range of 400 to 700 nm, if he coloring particle can be dispersed to achieve a particle dispersion diameter of 0.4 μm or less, a better advantage can be obtained.

If the volume average particle diameter of the resin particles of the developing-agent core is less than 0.04 μm, single polymerized particles which are not aggregated causes clumping and scattering of toner in the process of developing.

Although it depends on the type, the volume average particle diameter of the coloring agent particles adhered onto the resin particle of the developing-agent core should preferably fall within a range of 0.001 to 0.1 μm.

Further, the developing agent of the invention may be used as a single-component developing agent, or as a double-component developing agent consisting of toner and carrier. In the case of using as a double-component developing agent, the carrier particle should preferably have a volume average particle diameter of 20 to 120 μm, and more preferably 40 to 100 μm. The material of the carrier may be iron, nickel, cobalt, iron oxide, ferrite, glass beads, or the like, or the surface of these materials may be covered by a resin film. The material of the resin film may be methyl silicon, amine-added methyl silicon, phenyl silicon, acryl-modified silicon, melanine-crosslinked acryl, acryl floride, or the like.

According to the second aspect of the invention, there is provided a method of manufacturing the developing agent according to the first embodiment, comprising the steps of: i) forming a developing-agent core by adhering a coloring agent statically on the surface of a pre-polymerized substantially spherical resin fine particle; ii) forming a colloidal oil drop by swelling the developing-agent core with a monomer; iii) aggregating the colloidal oil drop into a non-uniformly-shaped aggregated material; and iv) polymerizing the non-uniformly-shaped aggregated material.

Figure 3:
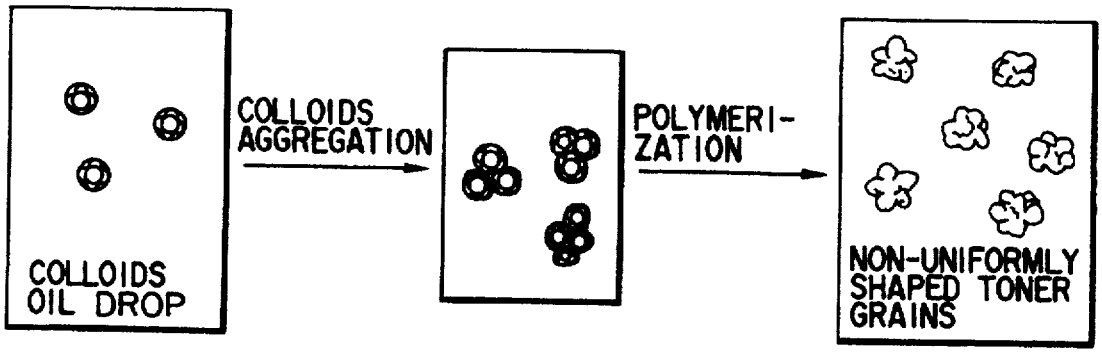
FIG. 3 is a diagram showing the production steps of the polymerized toner of the present invention.

The developing agent of the present invention is manufactured by a series of steps, namely, formation of a colloidal oil drop, aggregation of the colloidal oil drop, and polymerization of the aggregated material, which differ from the conventional 3 steps of polymerization, granulation, and ripening. The models of the particles in the steps involved in the present invention are diagrammed in FIG. 3. As can be seen in FIG. 3, the non-uniformly-shaped toner of the invention can be obtained by polymerizing a colloidal oil drop. The conventional technique entails the drawback of complicated polymerization of developing agent since, conventionally, the control of the particle diameter must be performed in each of the 3 steps, shown in FIG. 1. In the present invention, the control of the distribution of particle diameters during the formation of dispersed colloidal oil drops is not very important, and the particle diameter is only controlled in the later step of aggregation/polymerization of colloidal oil drops. Thus, the control of the particle diameter is conducted only once.

The third embodiment of the invention is a modification of the first embodiment.

According to the third aspect of the invention, there is provided a developing agent comprising a non-uniformly-shaped polymerized particle which is derived from a plurality of colloidal oil drops wherein the colloidal oil drops contain a first colloidal oil drop, having a first diameter, comprising a developing agent core and a first polymerized monomer for swelling the first developing agent core, and a second colloidal oil drop, having a second diameter larger than the first diameter, comprising plural developing agent cores and a second polymerized monomer for swelling the plural developing agent cores. The developing agent core preferably comprises a polymerized spherical resin particle and a coloring agent adhered onto said resin particle by an electrostatic force. The developing agent consists substantially of a polymer of a mixture containing a monomer, resin, and a coloring agent, and comprising an integrally polymerized particle having a projection and a recess.

Particles of the developing agent according to the third embodiment of the invention, some of which have projections, and the other have recesses, are integrally polymerized with each other. The surfaces of the particles of the developing agent are integrated with each other by chemical bonding. The developing agent manufactured in the manner expressed by the expression "integrated by chemical bonding" entirely differs from the developing agent obtained by combining a developing agent having a recess mechanically formed after the particle was shaped into a perfect sphere with an other developing agent particle by fusion using heat.

The anti-crush property of developing agents lowers when mechanically damaged during preparation thereof, and the shapes of particles becomes closer to perfect spheres when thermally damaged. However, the developing agent according to the third embodiment of the invention is obtained without being mechanically or thermally damaged during the preparation. Consequently, the developing agent of this type has an excellent anti-crush property, and its particles are desirably non-uniformely-shaped.

The developing agent with projections or recesses has a high friction coefficient against the cleaning member of the image forming device, and can be easily removed thereby, as compared to perfect spherical developing agents.

As in the case of the first embodiment, in the developing agent according to the third embodiment, the coloring agents are adhered onto a substantially spherical resin particle uniformly by a static force, and therefore a good dispersibility of the coloring particle in the developing agent is achieved. Such a developing agent is excellent in coloring ability, and transparency when used as color toner.

According to the fourth embodiment of the invention, there is provided a method of manufacturing a developing agent comprising the step of: i) forming a developing-agent core by adhering a coloring agent electrostatically on the surface of a pre-polymerized substantially spherical resin fine particle; ii) forming a first colloidal oil drop, having a first diameter by swelling the developing-agent core with a monomer; iii) forming a second colloidal oil drop, having a second diameter larger than the first diameter by colliding said first colloidal oil drops with each other; iv) aggregating a mixture of said first and second colloidal oil drops; v) forming a polymer particle having a projection or a recess by polymerizing the aggregated colloidal oil drops; and vi) classifying the polymer particles obtained in the polymerization step v).

In the fourth embodiment, the first colloidal oil drop and the second colloidal oil drop have almost the same composition as the first colloidal oil drop, and a particle diameter larger than the first oil drop, are formed in the reaction solution.

Figure 4:
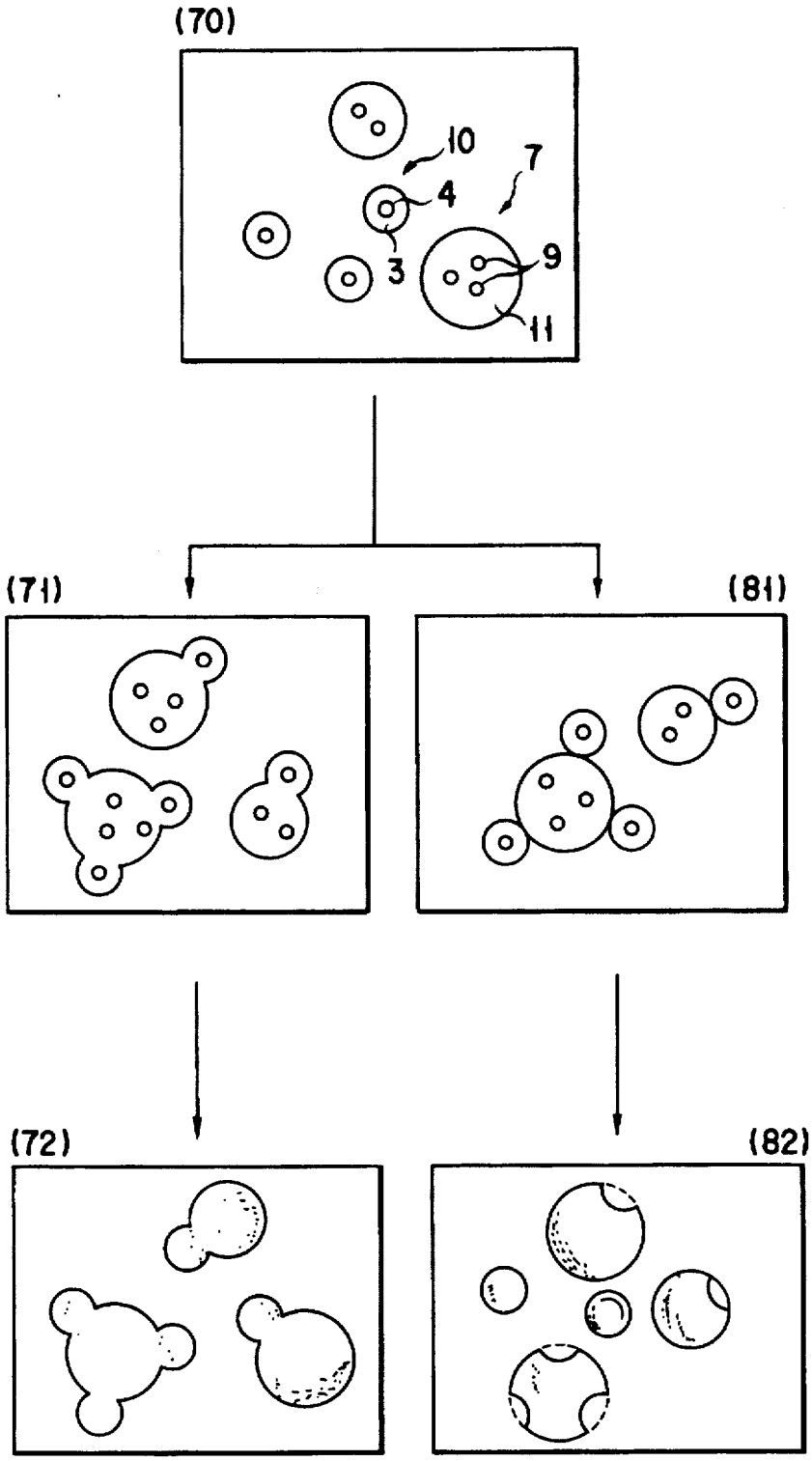
FIG. 4 is a diagram showing the production steps of the polymerized toner according to the fourth embodiment of the present invention.

FIG. 4 is a diagram showing the production steps of the polymerized toner according to the fourth embodiment. FIG. 4 (70) shows models of those colloidal oil drops. The first colloidal oil drop 10 consists of a core 4 including a resin particle, coloring agents, and the like, and a mixture 3 of a monomer surrounding the core 4 and serving to swell the core. The second colloidal oil drop 7 has a similar structure, and includes a core 9 and a monomer mixture 11.

Figure 5:
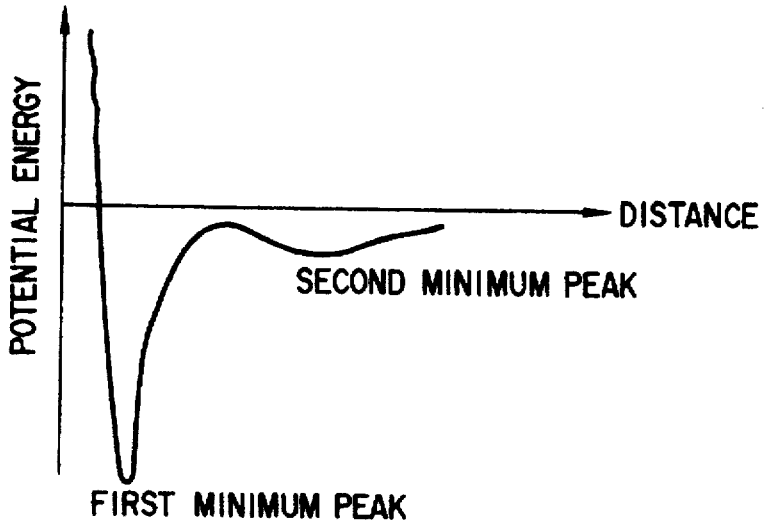
FIG. 5 is a graph showing the potential energy acting between the first and second colloidal oil drops with respect to the distance between the colloidal oil drops.

FIG. 5 is a graph showing a variation of the potential energy acting between the first and second colloidal oil drops along with the distance therebetween. As can be seen in FIG. 5, the potential energy has the first and second minimum values. When the potential energy is at the first minimum value, the energy is low and stable, and the first minimum value is the point where two colloidal oil drops are brought into contact and integrated with each other if they get closer. FIG. 4 (71) shows models of colloidal oil drops in this critical point.

As described above, the aggregation state in which the first and second colloidal oil drops are at the critical point for integration, is created, and the polymerization is conducted in the aggregation state. Thus, the first and second colloidal oil drops are chemically bonded with each other. Consequently, there can be obtained a toner having a structure in which a projection is integrally formed on the surface of a substantially spherical particle by chemical bonding. FIG. 4 (72) shows models of particles of this type of toner.

The second minimum point of the potential energy is a critical point where the first and second oil drops start to be reversibly aggregated. When the distance between the colloidal oil drops becomes larger than the state at this critical point, the colloidal oil drops are present independent from each other. FIG. 4 (81) shows the aggregation state of the colloidal oil drops at this point. When the polymerization is carried out in the reversible aggregation state, the first colloidal oil drop is removed from the second colloidal oil drop. Therefore, there can be obtained a toner consisting of the first polymerized material integrally formed by chemical bonding and containing particles with recessed surfaces, and the second polymerized material containing particles having surfaces matching with the recessed surfaces. FIG. 4 (82) shows models of particles of this type of toner.

According to the fourth embodiment, there can be obtained the developing agent consisting of polymers having projections or recesses, depending on the aggregation state of the first and second colloidal oil drops. By use of this method, the production time can be shortened as compared to the case where granulation, and thermal fusion are carried out after the developing agent particles are polymerized.

The developing agent having this type of shape of particles can be easily removed during cleaning because such particles have a large friction against the cleaning member. Further, the particles of this developing agent are prepared by polymerization in the state where projection or recesses are present. Therefore, such particles are less likely to be crushed as compared to those having mechanically formed recesses, or having projections by fusion using heat.

Some of the first colloidal oil drops can be stirred without being aggregated around the second colloidal oil drop while independently maintaining the state of the first colloidal oil drop during the polymerization step. Such colloidal oil drops thus stirred make polymerized material particles having substantially spherical shapes and particle diameters of, for example, 0.05 to 2 μm.

In the production step of polymers having recesses, some of the first colloidal oil drops are once aggregated around the second colloidal oil drops; however when stirred in the polymerization step, those ones of the first colloidal oil drops may be separated from the surfaces of the second colloidal oil drop. The separated colloidal oil drops make polymer particles having substantially spherical shapes and particle diameters of 0.05 to 2 μm.

As described above, according to the fourth embodiment, there can be obtained polymer particles having recesses or projections, and those having substantially spherical shapes and particle diameters of 0.05 to 2 μm, at the same time.

In the case where fine particles are present in great amount, there is a risk of creating an insufficient cleaning problem. While such polymer particles can be removed by classification, it is also possible to utilize these particles without removing them.

The following is a description of method of using such particles.

In the fourth embodiment of the invention, it is possible to mix the first colloidal oil drops into the second colloidal oil drops having large particle diameters at 0.5 to 10 wt %. If the mixture ratio is less than 0.5 wt %, the particles are not sufficiently non-uniformly shaped, and becomes closer to perfect spheres, thereby increasing the possibility of cleaning problem. If it is more than 10 wt %, fine particles are accumulated on, for example, the blade of the cleaning members, thereby creating a gap between the blade and the image carrier. Through this gap, developing agent particles, which are supposed to be cleaned, are likely to be left without being picked up. As a result, a cleaning error occurs, creating a character memory, and the like.

Further, it is preferable that the fine particles occupy 0.1 to 10 wt % in the developing agent.

In the fourth embodiment, the cleaning error can be prevented by making the particle diameters of the first colloidal oil drops 0.05 to 2 μm. If the particle diameter is less than 0.05 μm, particles tend to be clumped, whereas if it exceeds 2 μm, gaps tends to be formed between a blade and an image carrier body, and to permit the developing agent to slipping.

In the case where fine particles are utilized, the fine particles originated from the first colloidal oil drops serve as cleaning auxiliaries between the cleaning member and the image carrier. More specifically, the fine particles do not accumulate in the contact portion of the cleaning member and the image carrier, but serve as bearing-like members so as to smooth the operation of the cleaning member against the carrier. With use of such toner, the cleaning member can effectively operate in the cleaning means.

When the fine particles are utilized in the above-described manner, the cleaning property and the quality of the image can be upgraded without having classification of particles or adding other cleaning auxiliary, thus simplifying the preparation of the developing agent, and reducing the production cost.

The following is a description of the developing agent material used in the present invention.

Examples of the monomer used in the invention are: styrenes such as stylene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyene, p-n-butylstyrene, p-tert-butylstyrene, p-n-hexylstyrene, p-n-octylstyrene, p-n-nonylstyrene, p-n-decylstyrene, and p-n-dodecylstyrene, and the derivitives thereof; glycol groups such as ethylene glycol, and propylene glycol; unsaturated aliphatic acids such as maleinic acid anhydrate and phthalic acid anhydrate; ethylene unsaturated monoolefines such as ethylene, propylene, butylene, and isobutylene; vinyl halides such as vinyl chloride, vinyliden chloride, vinyl bromide, and vinyl floride; vinyl esters such as vinyl acetate, vinyl propionate, and vinyl benzoate; α-methylene aliphatic monocarbonate esters such as methyl methacrylate, ethyl methacrylate, propyl methacrylate, n-butyl methacrylate, iso-butyl methacrylate, n-octyl methacrylate, dodecyl methacrylate, 2-ethylhexyl methacrylate, stearyl methacrylate, phenyl methacrylate, dimethylaminomethyl methacrylate, and diethylaminoethyl methacrylate; acrylates such as methyl acrylate, ethyl acrylate, propyl acrylate, n-butyl acrylate, iso-butyl acrylate, n-octyl acrylate, dodecyl acrylate, 2-ethylhexyl acrylate, stearyl acrylate, phenyl acrylate, and 2-chloroethyl acrylate; vinyl ethers such as vinyl methyl ether, vinyl ethyl ether and vinyl iso-butyl ether; vinyl ketones such as vinylmethyl ketone, vinylhexyl ketone and methylisopropenyl ketone; n-vinyl compounds such as n-vinylpyrrole, n-vinylcarbazol, n-vinylindole, n-vinylpyrrolidone; vinylnaphthalenes; derivatives of acrylates and methacrylate such as acryl nitrile, methacrylonitrile and acrylamide.

In the invention, examples of the polymerization initiator are benzoylperoxide, di-t-butylperoxide, lauroylperoxide, t-butylhydroperoxide, cumenehydroperoxide, potassium persulfate, ammonium persulfate, acetyl peroxide, tetramethylthiuram disulfide, azobisisobutylonitryl, azobiscyclohexanenitril, phenylazotriphenylmethane, triethylaluminum, trimethylaluminum, ethylaluminumdichloride, diethylaluminum chloride, tetraethyllead, diethylzinc, diethylcadmium, tetraethyltin, titanium tetrachloride, aluminum chloride, aluminum bromide, stannic chloride, boron trifluoride-diethyl etherate, boron trifluoride, zinc chloride, and phosphor pentafluoride. In general, a sufficient amount of the initiator is about 0.5 to 5% of the monomer in weight.

Examples of the coloring agent are inorganic pigments (those available in nature, chromates, ferrocyane compounds, oxides, chlorides, sulfides, silicates, metal powders), organic pigments (natural dye lake, nitroso group, azo group, phthalocyanine group, condensed polycyclic group, basic dye lake, mordant dye group, vat dye group), water-soluble dyes, and oil-soluble dyes. Specific examples of the inorganic pigments are natural pigments such as loess; chromates such as chrome yellow, zinc yellow, barium yellow, chrome orange, molybdenum red, chrome green; ferrocyane compounds including Prussian blue; oxides such as titanium oxide, titanium yellow, titanium white, red iron oxide, yellowish iron oxide, zinc ferrite, zinc white, iron black, cobalt blue, chrome oxide, and spinel green; fluorides such as cadmium yellow, cadmium orange, and cadmium red; sulfates including barium sulfate; silicates such as calcium silicate and ultramarine; metal powders such as bronze and aluminum; and carbon black. Specific examples of the organic pigments are natural lakes including madder lake, nitroso pigments such as naphthol green, and naphthol orange; soluble azo-(azolake) group such as benzidine yellow G, Hansa yellow G, Hansa yellow 10G, vulcan orange, lake red R, lake red C, lake red D, watching red, brilliant carmine 6B, pyrazolone orange, bordeaux 10G (bonmaroon); insoluble azo groups such as pyrazoline red, para red, toluidine red, ITR red, toluidine red (lake red 4R), toluidine maroon, brilliant Feist scarlet, lake bordeaux 5B; azo pigments including condensed azo group; phthalocyanine pigments such as phthalocyanine blue, phthalocyanine green, bromo-phthalocyanine green, and Feist sky blue; anthraquinone group including slen blue; perylene group including perylene maroon, perylene orange; quinacridone group such as quinacridone and dimethyl quinacridone; dioxadine group including dioxadine violet; condensed polycyclic pigments such as isoindolinone group and quinophtalone; basic dye lakes such as Rhodamine 6b lake, Rohdamine lake B, and Malachite green; mordant dye group pigments including alizarine lake; vat dye group such as indanthrene blue, indigo blue, and anthoanthorone orange; fluorescent pigments; azine pigments (diamond black); and green gold. Specific examples of the water-soluble dyes are basic dyes including Rhodamine B, acidic dyes of orange, fluorescent dyes. Specific examples of the oil-soluble dyes are monoazo-dyes such as Feist orange R, oil red, and oil yellow; anthraquinone dyes such as anthraquinone blue, and anthraquinone violet; azine dyes such as nigrosine and induline; and basic, acidic, and metal complex compound dyes. In general, the amount of these dyes used should be in a range of 2 to 10% with respect to the weight of the monomer.

Examples of the coloring dispersing agent are cation dispersing agents including alkylamine salt, and quaternary ammonium salt.

During the fixation by a heat roller, wax or the like can be used for the purpose of enhancing the separatablility of the toner from the heat roller. Examples of the usable wax are low-molecular polyethylene, low-molecular polypropylene, and paraffin. An emulsion type wax can be also used.

Further, in order to better control the electrical charge, the charge controlling agent may be used. The charge controlling agent used may be of either the positive-charge type or negative-charge type. Examples of the positive-charge type controlling agent are electron-donating materials including a quaternary ammonium salt of nigrosin dye, and examples of the negative-charge type controlling agent are electron-accepting materials including a metal salt of monoazo-dye. The amount of the controlling material used should be in a range of 0.1 to 10% with respect to the amount of the monomer.

Examples of the surfactant used in the invention during the dispersion and polymerization of colloidal oil drops are sodium dodecylbenzensulfonate, sodium tetradecylsulfate, sodium pentadecylsulfate, sodium octylsulfate, sodium laurate, sodium caprate, sodium caprylate, sodium caproate, potassium stearate, calcium oleate, 3,3-disulfondiphenylurea-,4-diazo-bis-amino-8-naphthol-6-sodium sulfonate, orto-carboxybenzene-azo-dimethylaniline, 2,2,5,5-tetramethyl-triphenylmethane-4,4-diazo-bis-β-naphthol-sodium disulfonate. Examples of the dispersing assistant agent are vinyl acetate, acrylic acid, acrylonitrile, methyl acrylate, and acrylamide.

Examples of the present invention will now described in detail. As long as specifically defined, the amount is expressed in weight.

Figure 6:
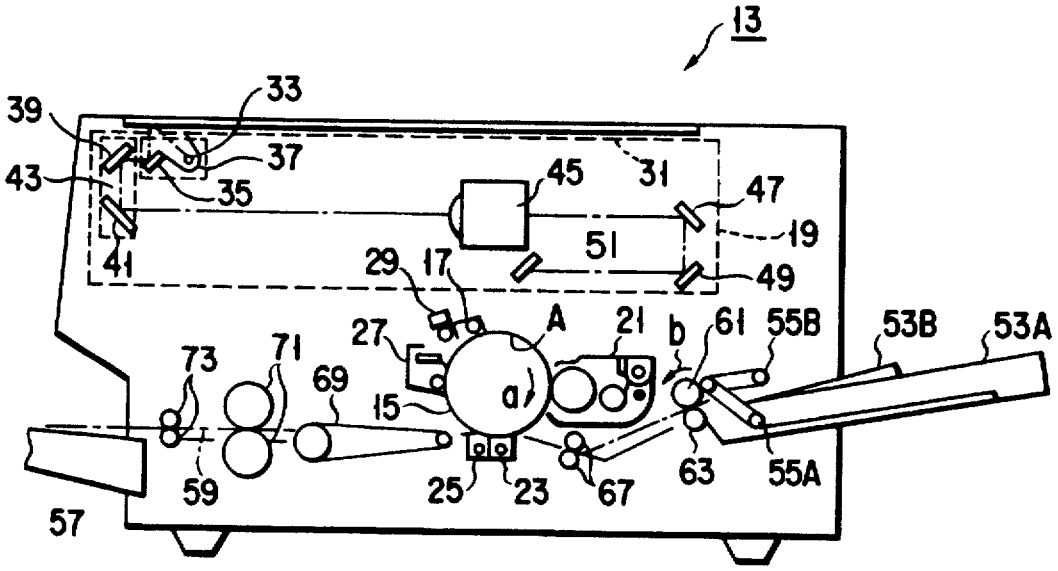
FIG. 6 is a diagram showing an example of an image device which can be used in the developing agent of the invention.

FIG. 6 is a brief explanatory diagram showing an electronic copy machine 13 to which the toner of the embodiments can be applied. This electronic copying machine 13 has, at its center portion, a photosensitive drum 15 having a surface, which serves as an image carrier, coated with a photoconductive layer. The photosensitive drum 15 can rotate in the direction indicated by arrow a shown in the figure. Around the photosensitive drum, the following members are fixedly provided along the rotational direction thereof. First, there is provided a charger 17 for uniformly charging the surface of the photosensitive drum 15. As shown in FIG. 6, above the photosensitive drum 15, provided is an exposure mechanism 19 for exposing the photosensitive drum 15 charged by the charger 17. In the downstream from the exposure position A of the photosensitive drum 15, which is exposed by the exposure mechanism 19, there is provided a developer unit 21 for developing a static latent image formed on the surface of the photosensitive drum 15 by exposure. In the downstream from the developer unit 21, there are provided a transfer charger 23 for transferring a visible image on a transfer material such as paper, and a striper charger 25 for striping the transfer material stuck on the photosensitive drum 15 by the transfer charger 23, therefrom. In the downstream from the remover charger 25, there are provided a cleaning unit 27 for removing toner remaining on the photosensitive drum 15 after transfer, and a deelectrifying lamp 29 for reducing the potential of the surface of the photosensitive drum 15 to be ready for the next transfer.

The exposure mechanism 19 corresponds to the section defined by broken line in FIG. 6. Further, as shown in FIG. 6, in the upper surface portion of the electronic copying machine 13, provided is a document holder 31 for holding a document. The structure of the exposure mechanism 19 will now be described. The exposure mechanism 19 includes an exposure lamp 33 for irradiating light on a document placed on the document holder, a first carriage 37 having a first reflection mirror 35 for reflecting the light irradiated from the exposure lamp 33, a second carriage 43 having a second reflection mirror 39 and a third reflection mirror 41, a lens 45 for forming an image from the reflection light, a fourth reflection mirror 47, a fifth reflection mirror 49 and a sixth reflection mirror 51. The first carriage 37 moves back and forth along the document holder 31. In order to keep the length of the optical path constant, the second carriage 43 moves back and forth at a half a speed of the first carriage 37.

As shown in FIG. 6, a paper-feeding cassette 53A which can hold sheets, and a manual paper-feeding supporter 53B are provided on the right-hand side of the electronic copying machine 13. In the electronic copying machine, there are provided pick-up rollers 55A and 55B for withdrawing a sheet from the cassette 53A or the manual paper-feeding supporter 53B. Further, the electronic copying machine 13 includes a discharged paper tray 57 onto which a copy sheet is discharged. Between the discharged paper tray 57 and the paper-feeding cassette 53A, there is formed a sheet conveying path 59 for transferring a sheet. In FIG. 6, the paper conveying path 59 is indicated by a single-dot broken line. In the upstream-side from the photosensitive drum 15 along the paper-feeding path 59, provided are a pair of rollers consisting of a paper-feeding roller 61 and a separator roller 63, and a resist roller pair 67. The paper-feeding roller 61 and the separator roller 63 are arranged such as to vertically face to each other. The paper-feeding roller 61 is rotatable in the direction indicated by arrow b in the figure, and serves to send a sheet picked up by the pick-up roller 55A or the pick-up roller 55B, to the resist roller pair 67. The separator roller 63 is rotatable in the same direction as or the reverse direction to the paper-feeding roller 61. In the case where two or more sheets are sent from the pick-up roller 55A or 55B, the separator 63 rotates in the reverse direction to that of the paper-feeding roller 51, so as to separate only one sheet, and send a sheet to the cassette 53A or the manual paper-feeding supporter 53B. In the case where one sheet is picked up by the pick-up roller 55A or 55B, the separator roller 63 rotates as being urged by the rotation of the paper feeding roller 61. The resist roller pair 67 straightens the sheet as the pair abuts against the front end of the sheet carried through the sheet conveying path 59 by the paper-feeding roller 61, and then the roller pair 67 sends the sheet again to the sheet conveying path 59.

In the downstream side from the photosensitive drum 15 along the sheet conveying path 59, provided are a transfer belt 69 for transferring a sheet, a fixing roller pair 71 for fixing the toner transferred on the sheet, and a paper discharge roller 73 for discharging the sheet on which the fixation was completed, onto the discharged paper tray 57.

Regarding the electronic copying machine 13 having the above-described structure, the operation of forming an image will be described. First, the exposure lamp 33 of the exposure mechanism 19 lights up, and the first carriage 37 starts an irradiation on the document placed on the document holder 31. The reflection light is exposed on the photosensitive drum 15. The surface of the photosensitive drum 15 is uniformly charged in advance by the charger 17, and a static latent image is formed on the photosensitive drum 15 each time the drum is exposed.

The photosensitive drum 15 rotates at a predetermined rotation speed. When the drum rotates and is set to the position of the developer unit 21, toner is supplied on the static latent image from the developer unit 21, and the toner is adhered on the static latent image by a static attraction force, thereby conducting development. After the development, the photosensitive drum 15 further rotates, and when set to the position corresponding to the transfer charger 23, the toner image is transferred onto a sheet.

The sheet is picked up from the paper-feeding cassette 53A by the pick-up roller 55A. The sheet picked up by the pick-up roller. 55A passes between the paper feeding roller 61 and the separator roller 63, and is sent to the resist roller pair 67. The sheet is further carried from the resist roller pair 67 through the paper conveying path 59 to the position corresponding to the transfer charger 23.

The sheet on which the image of the document is formed by the transfer is stripped from the photosensitive drum 15 by means of the stripper charger 25, and conveyed on the conveying belt 69 to the fixing roller pair 71. The image is fixed on the sheet by the fixing roller pair 71. After the fixation, the copy sheet is discharged onto the discharged paper tray 57 by the paper discharge roller pair 73.

The toner remaining non-transferred on the photosensitive drum 15 is removed and collected by the cleaning unit 27. Further, the photosensitive drum 15 is deelectrified by the deelectrification lamp 15, thus completing one cycle of the image forming process. Then, the operation moves onto the next cycle.

Figure 7:
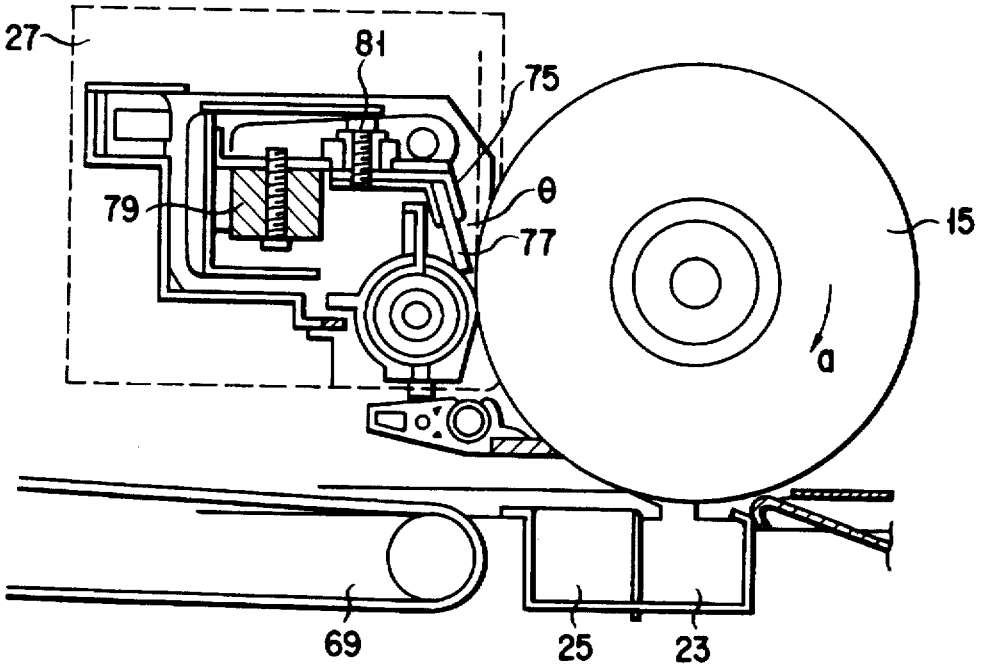
FIG. 7 is a diagram showing an enlarged view of the cleaning device provided in the image forming device shown in FIG. 6.

The above-described cleaning unit will be described. FIG. 7 shows an enlarged cross section of the cleaning unit 27. The cleaning unit 27 employs a blade cleaning mode, in which a cleaning blade 77 made of an elastic body having a thickness of 2 mm and a free length of 10 mm, fixed to the supporting member 75 abuts against the photosensitive drum 5 by its tip end. An acute angle is made at the abutting section between the cleaning blade 77 and the tangent line. The supporting member 75 consists of two metal plates, between which the cleaning blade 77 is interposed.

A steel-plate weight 79 is set on the supporting member 75. The supporting member 75 is fixed to the cleaning unit 27 by a screw 81, which serves as a fulcrum such that the cleaning blade 77 is urged upward by means of the weight 79. As the supporting member 75 is urged upward, the cleaning blade 77 is pressed against the photosensitive drum 15 at a pressure of about 20 g/cm.

As described above, the cleaning blade 77 pressed against the photosensitive drum 15 intersects with the surface of the photosensitive drum 15 which rotates in the direction indicated by arrow a in the figure, and scrapes the toner off the drum.

The cleaning blade 77 is made of an elastic member such as a urethane rubber. It is preferable that the thickness and the free length of the cleaning blade 77 are set to 1 to 3 mm, and 4 to 20 mm, respectively. The amount of crouching of the cleaning blade 77 into the photosensitive drum should be set within a range of 0.3 to 3.5 mm, preferably 0.5 to 2 mm. By setting the crouching amount as mentioned above, the cleaning blade 77 can be operated in a desirable manner by an appropriate pressure of 10 to 50 g/cm.

It is required that the cleaning blade 77 has not only a good cleaning property, but also a performance for preventing damages to the photosensitive drum, a performance for preventing the vibration of the device during cleaning, etc. The elastic member tends to degrades its elastic property at a low temperature of 5° to 10° C. Further, if the blade is left in a deformed state as abutting to the photosensitive drum 5 for a long period of time, the blade may loses its elasticity.

In order to maintain a good elastic property, it is preferable that the elastic member maintains the Young's modulus at 30 to 120 kg/cm$^2$, and the rebound elasticity at 10 to 80%.

The contact angle θ between the photosensitive drum 15 and the cleaning blade 77 should be maintained at 3° to 10° when the photosensitive drum is stationary.

EXAMPLES

Examples in connection with the first and second embodiments of the present invention will be described.

Example 1

Preparation of anion group resin emulsion

The materials listed below were placed in a four-neck flask, and while stirring at a speed of 300 rpm, the emulsion polymerization was carried out at 80° C. for 10 hours. Thus prepared was a solution containing resin particles having a volume average particle diameter of 0.2 μm, each of which serves as the core of a colloidal oil drop.

| | |
|---|---|
| Styrene | 40 parts by weight |
| Butyl acrylate | 10 parts by weight |
| Acrylic acid | 1 parts by weight |
| Sodium dodecylbenzenesulfonate | 1 parts by weight |
| Hydrogen peroxide | 1 parts by weight |
| Preparation of Monomer Mixture Solution 1A | |
| A monomer mixture solution was prepared by mixing the materials listed below. | |
| Styrene monomer | 60 parts by weight |
| Butyl acrylate | 15 parts by weight |
| Acrylic acid | 2 parts by weight |
| Sodium dodecylbenzenesulfonte | 1 parts by weight |
| Benzoyl peroxide | 1 parts by weight |
| Preparation of Dispersion Solution 1B | |

The materials listed below were dispersed by a ball mill and nannomizer, and there is obtained a dispersion solution 1B containing carbon particles adhered by a static attraction force on the surface of the resin particles having a volume average diameter of 0.2 μm.

| | |
|---|---|
| 20% anion-group resin emulsion | 30 parts by weight |
| 10% cation carbon black dispersion solution | 40 parts by weight |
| Water | 150 parts by weight |

i) Preparation of Colloidal Oil Drop

The mixture solution 1A was mixed into the dispersion liquid 1B while stirring the mixture solution. The resin particles to each of which carbon particles in the dispersion liquid 1B are adhered were swelled by the mixture solution A, thus obtaining colloidal oil drops having a volume average particle diameter of 2 μm.

ii) Aggregation of Colloidal Oil Drops

The pH value of the obtained mixture is adjusted to about 4.0 by sodium hydrogenphosphate, thus aggregating the colloidal oil drops.

iii) Polymerization of Aggregated Colloidal Oil Drops

The stirring speed was set to 350 rpm, and the polymerization was carried out for 8 hours at a reaction temperature of 70° C., thus obtaining a polymer of aggregated oil drops of non-uniformly shaped particles, having a solid portion of about 30%.

After that, the polymer was filtrated, washed, and subjected to vacuum drying at 45° C. for 10 hours, thereby obtaining the target non-uniformly-shaped-particle toner.

The 50%-volume average particle diameter of thus obtained toner was measured by a coulter counter, and was 7.3 μm, and the shape coefficient was as high as 7.5.

By use of this toner and the commercially available copying machine (tradename: PDL600 of TOSHIBA), the development was conducted. Even after development of 20,000 sheets, a character memory did not occur. Here, the particle diameter was again measured by the coulter counter, and the 50%-volume average particle diameter at this point was found to be 7.1 μm, indicating that the volume average diameter did not change much. Further, the generation of fine particles was not observed. The image density was measured by the reflection density meter, MACBETH R918, and found to be 1.40. Thus, a clear image of a high transfer efficiency was obtained.

Further, regarding the toner obtained, the cleaning property, the anti-crush property, the coloring ability/transparency were evaluated, and the results were summarized in Table 1.

It should be noted that the washing step for the obtained polymer can employ, for example, the water flow method of washing the toner by flowing water, the washing solution circulation method in which a adsorber layer for adsorbing the surfactant in the washing solution water is provided in the middle of the circulation, the shower method of showering the toner, or the stirring method of washing the toner by stirring the toner in a solution using, for example, an ultrasonic wave.

Further, the character memory is a phenomenon defined as follows:

As the steps of formation of latent images, development, and transfer are repeated, a cleaning error occurs, leaving some of the toner on the drum behind, and the remaining portion of the toner is transferred during the next cycles of formation of latent images, development, and transfer.

The cleaning property, the anti-crush property, the coloring ability/transparency were evaluated in the following manners.

Evaluation of Cleaning property

By use of a commercially available copying machine (tradename: PDL600 of TOSHIBA), a developing operation was run on 20,000 sheets. The evaluation was based on whether or not the character memory occurs.

○ . . . no character memory occurred

X . . . character memory occurred

Evaluation of Anti-crush Property

By use of a commercially available copying machine (tradename: PDL600 of TOSHIBA), a developing operation was run on 20,000 sheets. After that, the diameters of the developing agent particles in the developing unit were measured by the coulter counter, and the measured values were compared with those obtained before the running of development. The evaluation was based on the increase in ratio of the developer particles having diameter of 2 μm or less.

○ . . . no change observed

X . . . the average diameter changed by 0.5 μm or more, or the ratio of the particles having diameters of 2 μm or less increased by 5% or more Evaluation of Coloring Ability/Transparency Formation of an image was carried out under the conditions including a nip width of 7.5 mm, a conveying speed of 135 mm/sec, a heat roller temperature of 160° C. The maximum reflection density of the obtained image was measured by Macbeth R918, and evaluated on the basis of the followings.

○ . . . reflection density of 1.3 or higher

Δ . . . reflection density of 0.8 or higher but less than 1.3

X . . . reflection density of 0.8 or less

Example 2

Toner was obtained in the same fashion as in Example 1, except that the 10% cation-group carbon black dispersion liquid was replaced by 40 parts by weight of 10% phthalocyanblue dispersion liquid.

The toner thus obtained was measured by the coulter counter as in Example 1, and it was found that the 50%-volume average particle diameter was 6.4 μm, and the shape coefficient was 6.7.

By use of this toner and the commercially available copying machine (tradename: PDL600 of TOSHIBA), the development was conducted. Even after development of 20,000 sheets, a character memory did not occur. Here, the particle diameter was again measured by the coulter counter, and the 50%-volume average particle diameter at this point was found to be 6.2 μm, indicating that the average diameter did not change much from that before use. Further, the generation of fine particles was not observed.

Further, the transferred image was fixed by the heat roller under the conditions including a nip width of 7.5 mm, a conveying speed of 135 mm/sec, a heat roller temperature of 160° C. The maximum reflection density of the obtained image measured by the reflection density meter, Macbeth R918, with use of SIP filter (RED) inserted therein, and found to be 1.8.

Moreover, a cyan color image was formed on a transparent PET film, and fixed under the same conditions as above. Thus obtained image exhibited a good transparency in color.

Thus obtained toner was evaluated in terms of cleaning property, anti-crush property, and coloring ability/transparency. The results were as shown in Table 1.

CONTROLS 3 and 4

Yellow toner of non-uniformly shaped particles, and magenta toner of non-uniformly shaped particles were prepared in the same manner as in the Example 2 except that the pigment used, i.e., phthalocyanine blue, was replaced by benzene yellow and permanent rhodamine.

The 50%-volume average particle diameters of the yellow toner and the magenta toner were 6.8 μm and 7.4 μm, respectively, and the shape coefficients thereof were 6.2 and 6.5, respectively.

By use of each type of toner and the commercially available copying machine (tradename: PDL600 of TOSHIBA), the development was conducted. Even after development of 20,000 sheets, a character memory did not occur. Here, the particle diameter was again measured by the coulter counter, and the results indicated that the average diameter did not change much from that before use. Further, the generation of fine particles was not observed.

The fixation of an image was conducted in each case of those toners as in Example 1. The maximum image density of the yellow image (with use of SPI filter blue) was 1.7, and that of the magenta image (with use of SPI filter GREEN) was 1.75. Also, each case exhibited a good transparency in color and a high image density.

Yellow and magenta color images were formed on transparent PET films, and fixed under the same conditions. Each case exhibited a good transparency in color. Further, three-color toners obtained in Examples 2, 3, and 4 were used to form a full-color image on a transparent PET film, and the formed image was fixed under the same conditions as above. The fixed image exhibited a good transparency in color.

Also, each of the obtained toners was evaluated in terms of cleaning property, anti-crush property, and coloring ability/transparency. The results were as shown in Table 1.

CONTROLS 1 and 2

| | |
|---|---|
| Styrene monomer | 60 parts |
| Butyl acrylate | 15 parts |
| Acrylic acid | 2 parts |
| Sodium decylbenzenesulfonate | 1 parts |
| Benzoyl peroxide | 1 parts |
| 20% anion-group resin emulsion | 30 parts |
| 10% cation carbon black dispersion solution | 40 parts |
| Water | 150 parts |

The above-listed materials were dispersed by the ball mill and the nannomizer, and a mixture solution was obtained. The pH value of the obtained mixture was adjusted to about 4.0 by sodium hydrogenphosphate. Then, the stirring speed was set to 450 rpm, and the polymerization was carried out for 8 hours at a reaction temperature of 90° C., thus obtaining primary particles having a volume average particle diameter of 5 μm.

Then, the temperature was lowered to 50° to 60° C., and the stirring speed was set to be 200 rpm, so as to aggregate the primary particles. Thus, granulated were secondary particles having a volume average particle diameter of 9.5 μm.

The obtained secondary particles were divided into two groups, and the two groups were ripened both at 98° C. for 4 and 8 hours, respectively, thus obtaining two types of non-uniformly-shaped combination particles having a solid portion of about 30%. These particles were filtrated and washed, and then subjected to vacuum dry at 45° C. for 10 hours. The target non-uniformly-shaped particle toners were thus obtained.

The two types of toners obtained by ripening-time periods of 4 and 8 hours were measured by the coulter counter as in Example 1, and it was found that the 50%-volume average particle diameters of the two types of toners were 9.2 μm and 9.0 μm, respectively, the distributions of the particle diameters were 3.6 μm and 3.5 μm, respectively, and the shape coefficients were 5.5 and 3.2, respectively. When the ripening time is short, a high shape coefficient and a high cleaning property were obtained; however the generation of fine particles was observed in the test for anti-crush property. In contrast, when the ripening time is long, the shape coefficient was low, and the cleaning error occurred, though the generation of fine particles was not observed. Further, the image density was measured by the reflection density meter, MACBETH R918, and each case exhibited a value 1.40, thus no indication of degradation was observed.

Also, each of the obtained toners was evaluated in terms of cleaning property, anti-crush property, and coloring ability/transparency. The results were as shown in Table 1.

CONTROLS 3, 4, 5, and 6

The non-uniformly shaped particle toners were obtained in Examples 3 to 6 regarding carbon black, phthalocyanine blue, benzidine yellow, and permanent rhodamine, respectively, in the same manner as in Example 1 except that the resin emulsion having a volume average particle diameter of 0.6 μm was used.

Thus obtained toners were examined in terms of specific particle diameter and shape coefficient, and evaluated in terms of cleaning and anti-crush properties. The results were as shown in Table 1. As can be seen in Table 1, in each example, no prominent changes were observed regarding the specific particle diameter, the shape coefficient, etc., and a good cleaning property and a good anti-crush property were exhibited in the 20,000-running test similar to that of the Example 1. However, the image density of carbon black toner was lowered to 1.23, and the maximum reflection density of each color toner was 0.8 or less.

CONTROLS 7, 8, 9, and 10

The non-uniformly shaped particle toners were obtained in the same manner as in Example 2 except that the resin emulsions having volume average particle diameters of 0.1, 0.3, 0.5 and 0.76 μm (respectively corresponding to Examples 7 to 10) were used. As can be seen in Table 1, in each example, no prominent changes were observed regarding the specific particle diameter, the shape coefficient, etc., and the results of the 20,000-running test similar to that of the Example 1 were good.

The maximum reflection density of each of the color toners containing resin particle having average diameters of 0.1 and 0.3 μm, was about 1.8, whereas the maximum reflection densities of those containing resin particle having average diameters of 0.5 and 0.7 μm, were 0.95 and 0.8, respectively.

TABLE 1

| | Resin particle diameter | Diameter of non-uniformly shaped toner particle | Shape coefficient | Cleaning property | Anti-crush property | Coloring ability/ transparency |
|---|---|---|---|---|---|---|
| Example | | | | | | |
| 1 | 0.2 μm | 7.3 μm | 7.5 | ○ | ○ | ○ |
| 2 | 0.2 | 6.4 | 6.7 | ○ | ○ | ○ |
| 3 | 0.2 | 6.8 | 6.2 | ○ | ○ | ○ |
| 4 | 0.2 | 7.4 | 6.5 | ○ | ○ | ○ |
| Control | | | | | | |
| 1 | 0.2 | 4.2 | 5.2 | ○ | X | ○ |
| 2 | 0.2 | 9.0 | 3.2 | X | ○ | ○ |
| 3 | 0.6 | 7.5 | 7.2 | ○ | ○ | Δ |
| 4 | 0.6 | 6.5 | 6.8 | ○ | ○ | X |
| 5 | 0.6 | 7.0 | 6.4 | ○ | ○ | X |
| 6 | 0.6 | 7.5 | 6.3 | ○ | ○ | X |
| 7 | 0.1 | 7.2 | 6.8 | ○ | ○ | ○ |
| 8 | 0.3 | 6.8 | 6.7 | ○ | ○ | ○ |
| 9 | 0.5 | 7.1 | 7.1 | ○ | ○ | Δ |
| 10 | 0.7 | 7.0 | 7.2 | ○ | ○ | X |

Example 5

Examples in connection with the third and fourth embodiments of the present invention will be described.

Preparation of anion group resin emulsion:

The materials listed below were placed in a four-neck flask, and while stirring at a speed of 300 rpm, the emulsion polymerization was carried out at 80° C. for 10 hours. Thus, a resin containing particles having a volume average particle diameter of 0.3 μm, each of which serving as the core of a colloidal oil drop was prepared.

| | |
|---|---|
| Styrene | 70 parts |
| Butyl acrylate | 15 parts |
| Acrylic acid | 1 parts |
| Sodium dodecylbenzenesulfonate | 1 parts |
| Hydrogen peroxide | 1 parts |
| Preparation of Monomer Mixture Solution 5A | |
| Styrene monomer | 60 parts |
| Butyl acrylate | 15 parts |
| Acrylic acid | 2 parts |
| Sodium dodecylbenzenesulfonate | 1 parts |
| Benzoyl peroxide | 1 parts |
| Preparation of Dispersion Solution 5B | |

The materials listed below were dispersed by a ball mill and nannomizer, and there is obtained a dispersion solution 1B containing carbon particles adhered by a static attraction force on the surface of the resin particles having a volume average diameter of 0.2 μm.

| | |
|---|---|
| 20% anion-group resin emulsion | 30 parts |
| 10% cation carbon black dispersion solution | 40 parts |
| Water | 150 parts |

i) Preparation of First Colloidal Oil Drop

The dispersion liquid 5B and the mixture solution 5A were dispersed and mixed by the ball mill and the nannomizer so that the carbon-particle-adhered resin particles of the dispersion liquid 5B were swelled by the mixture solution. Thus, a solution containing the first colloidal oil drops having a volume average particle diameter of 1.5 μm was obtained.

ii) Preparation of Second Colloidal Oil Drop-Collision Process of Colloidal Oil Drops 70% of the first colloidal solution was stirred by a homogenizer at 6000 rpm for 15 minutes, As the solution was stirred, colloidal oil drops collide with each other, thus obtaining a solution containing the second colloidal oil drops having a volume average particle diameter of 7 μm.

iii) Aggregation of First and Second Colloidal Oil Drops

The solutions containing the first and second colloidal oil drops were mixed together. The mixture solution was transferred into a four-neck flask. The pH value of the obtained mixture is adjusted to about 4.0 by sodium hydrogenphosphate, thus aggregating the colloidal oil drops. The solution containing the aggregated colloidal oil drops is stirred at a stirring rate of 600 rpm for 30 minutes.

After stirring, a portion of the solution is sampled, and an aggregated body obtained was observed under an optical microscope. It was found that about 1 to 5 fine particle colloidal oil drops having diameters of a few μm are adhered to a colloidal oil drop having a particle diameter of 5 to 10 μm. The aggregated body have been made finally into the above-described state as adhesion and removal were repeated during stirring.

iii) Polymerization of Aggregated Colloidal Oil Drops

A solution containing aggregated colloidal oil drops obtained by the above aggregation step was polymerized in the following manner. That is, the temperature of the solution was maintained at 70° C., and a polymerization initiator was added in the polymerization step. Then, the polymerization was carried out as the solution was stirred for 8 hours. After the polymerization, non-uniformly shaped polymer particles each having substantially a spherical shape, the surface of which has a recess was obtained. The polymer particles were filtrated and washed.

Figure 8:
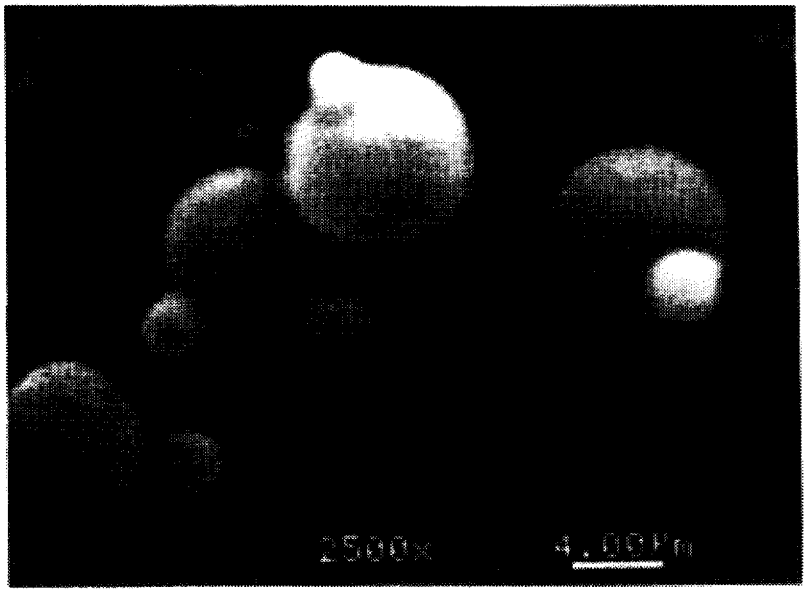
FIG. 8 is a photograph showing the state of particles of the developing agent, the surface of each of which has a projection.

After that, the obtained polymers were subjected to vacuum drying at 45° C. for 10 hours, and then classified, thus obtaining the target non-uniformly shaped particle toner. FIG. 8 is a photograph showing an enlarged view of toner particles. As can be seen in FIG. 8, each particle has a non-uniform shape having a few projections on the surface of the particle. The particles were measured by the coulter counter, and it was found that the 50%-volume average particle diameter was 8.2 μm, and the shape coefficient was as high as 7.5.

By use of this toner and the commercially available copying machine (tradename: PDL600 of TOSHIBA), the image formation was conducted. Even after image formation on 20,000 sheets, a character memory did not occur. Here, the particle diameter was again measured by the coulter counter, and the 50%-volume average particle diameter at this point was found to be 8.2 μm, indicating that the average diameter did not change much. Further, the generation of fine particles was not observed. The image density was measured by the reflection density meter, MACBETH R918, and found to be 1.45. Thus, a clear image of a high transfer efficiency was obtained.

Further, the image output was conducted on 5000 sheets under a high-temperature and high-humidity condition, i.e. a temperature of 35° C., and a moisture of 85%. It was found that no fog was created on the drum, or the toner consuming amount increased only by 5% with respect to the case of the condition room temperature and regular moisture. Therefore, it was concluded that the toner of the present invention had a good moisture-proof property.

Further, regarding the toner obtained, the cleaning property, the anti-crush property, the coloring ability/the transparency were evaluated as in the Example 1, and the results were summarized in Table 2.

It is preferable that the first colloidal oil drops have a volume average particle diameter of 0.05 to 20 μm. The volume average particle diameter of the second colloidal oil drops may be not more than 20 μm, preferably 4 to 10 μm. By setting the average diameters of the first and second colloidal oil drops within the above ranges, there can be obtained a toner containing particles having a volume average particle diameter of 0.5 to 20 μm, preferably 4 to 10 μm, which is most suitable as a developer. The first colloidal oil drop usually has a size of about 1.3 times as large as that of the core used. Consequently, in order to obtain colloidal particles of particle diameters of 0.05 to 2.0 μm, cores having diameters of about 0.04 to 0.15 μm may be used.

Example 6

As in the Example 5, the steps i) and ii) were conducted, and the colloidal solutions were mixed. Then, the mixture was stirred at a speed of 6000 rpm for 20 minutes so as to collide colloidal oil drops with each other. After that, the pH value of the obtained mixture was adjusted to 7.0, and the mixture was stirred at a stirring rate of 300 rpm for 30 minutes.

After stirring, a portion of the solution is sampled, and an aggregated body obtained was observed under an optical microscope. It was found that about 1 to 5 fine particle colloidal oil drops having diameters of a few μm were adhered to a colloidal oil drop having a particle diameter of 5 to 10 μm.

Figure 9:
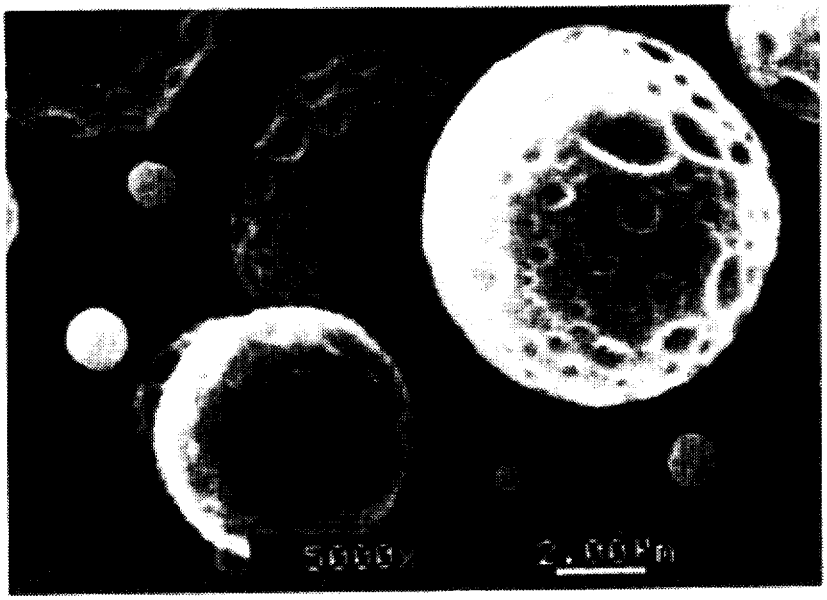
FIG. 9 is a photograph showing the state of the particles of the colloidal oil drop aggregated material having a recess, according to the present invention.

While setting the temperature of the mixture at 80° C., the mixture was subjected to polymerization for 10 hours. The polymer particles thus obtained were filtrated, washed, dried, and classified, thus obtaining a target non-uniformly shaped particle toner. FIG. 10 is a photograph showing an enlarged view of toner particles obtained. As can be seen in FIG. 9, each particle has a non-uniform shape having a number of recesses on the surface of the particle. The particles were measured by the coulter counter, and it was found that the 50%-volume average particle diameter was 7.8 μm, and the shape coefficient was as high as 7.0.

By use of this toner and the commercially available copying machine (tradename: PDL600 of TOSHIBA), the image formation was conducted. Even after image formation on 20,000 sheets, a character memory did not occur. Here, the particle diameter was again measured by the coulter counter, and the 50%-volume average particle diameter at this point was found to be 7.8 μm, indicating that the average diameter did not change much. Further, the generation of fine particles was not observed. The image density was measured by the reflection density meter, MACBETH R918, and found to be 1.41. Thus, a clear image of a high transfer efficiency was obtained.

Further, the image output was conducted on 5000 sheets under a high-temperature and high-humidity condition, i.e. a temperature of 35° C., and a moisture of 85%. It was found that no fog was created on the drum, or the toner consuming amount increased only by 5% with respect to the case of the condition room temperature and regular moisture. Therefore, it was concluded that the toner of the present invention had a good moisture-proof property.

One of the reasons why the toner of the present invention has a good moisture-proof property is that dispersion stabilizers including a surfactant are not contained in the developer of the invention. In the conventional method, a dispersion stabilizer such as a surfactant must be used for aggregating the remaining primary particles. Consequently, some of the dispersion stabilizer remains in the primary particles. In contrast, the aggregation can be performed in the invention without the dispersion stabilizer for binder, thus the surfactant does not remain.

In the Examples 5 and 6, the second colloidal oil drops are formed by the collision process; however the invention is not limited to these examples. The second colloidal oil drops can be formed, for example, by any of the following methods:

1) The mechanical method using the first colloidal oil drops, in which the first colloidal oil drops are collided with each other by stirring the solution containing the drops at a high rotation speed;
2) The chemical method using the first colloidal oil drops, in which the pH or the density of the dispersion liquid containing the oil drops is adjusted, or salt is added to the liquid.
3) The method without using the first colloidal oil drops, in which the second colloidal oil drops are formed by use of resin particles having diameters of, for example, 4 to 10 μm as their cores.

Further, it is also possible that colloidal oil drops are aggregated while forming the second colloidal oil drops. There are a number of possible versions for this, and examples of such versions will be described.

Example 7

As in the Example 5, the first colloidal oil drops having a particle diameter of 1.5 μm are formed.

The first colloidal solution was transferred into a four-neck flask, and the pH value of the solution was adjusted to 4.0 using sodium hydrogenphosphate. The mixture was further stirred at a stirring rate of 600 rpm so as to aggregate the particles. In the mixture, observed are granulated non-uniformly shaped particles having diameters of about 6 to 7 μm, each having a structure in which an about-2 μm-colloidal oil drop is aggregated on an about-5 μm-colloidal oil drop.

while setting the temperature of the mixture at 70° C., the mixture was subjected to polymerization using a polymerization initiator for 8 hours. After the polymerization, the non-uniformly shaped polymers each having a shape in which a projection was formed on the surface of the substantially spherical particle. The polymer particles thus obtained were filtrated, washed, and dried.

After that, the polymers were subjected to vacuum drying at 45° C. for 10 hours, and classified, thus obtaining a target non-uniformly shaped particle toner. The volume average particle diameter of the toner was 8.0 μm.

The toner was examined by various tests as in the Example 6. The results indicated that no character memory occurred, and the anti-crush property and the moisture-proof property were good.

Example 8

As in the Example 6, the first colloidal oil drops having a particle diameter of 1.5 μm are formed.

The solution containing the obtained colloidal oil drops was stirred by a homogenizer at 6000 rpm for 20 minutes, so as to carry out a mixture collision process. Then, the pH value of the solution was adjusted to 7.0, and the solution was further stirred at a stirring rate of 300 rpm. In the mixture, observed are aggregated non-uniformly shaped particles having diameters of about 7 μm, each having a structure in which an about 2 μm-colloidal oil drop is aggregated on an about 5 μm-colloidal oil drop.

While setting the temperature of the mixture at 70° C., the mixture was subjected to polymerization using a polymerization initiator for 8 hours. After the polymerization, the non-uniformly shaped polymers each having a shape in which a recess was formed on the surface of the substantially spherical particle. The polymer particles thus obtained were filtrated, washed, and dried. (After that, the polymers were subjected to vacuum drying at 45° C. for 10 hours, and classified, thus obtaining a target non-uniformly shaped particle toner.) The volume average particle diameter of the toner was 9.0 μm.

The toner was examined by various tests as in the Example 6. The results indicated that no character memory occurred, and the anti-crush property and the moisture-proof property were good.

Example 9

As in the Example 6, the first colloidal oil drops having a particle diameter of 1.5 μm are formed.

The pH value of the solution containing the obtained colloidal oil drops was adjusted to 3.0, and the solution was stirred at stirring rate of 8000 rpm for 15 minute by using homogenizer. Then, the pH value of the solution was adjusted to 7.0, and the solution was stirred at a stirring rate of 500 rpm. In the mixture, observed are aggregated non-uniformly shaped particles each having a structure in which an about-1.5 μm-colloidal oil drop is aggregated on an about-8 μm-colloidal oil drop. While setting the temperature of the mixture at 80° C., the mixture was subjected to polymerization using a polymerization initiator for 6 hours. After the polymerization, the non-uniformly shaped polymers each having a shape in which a recess was formed on the surface of the substantially spherical particle. The obtained polymer particles thus obtained were filtrated, washed, and dried. (After that, the polymers were subjected to vacuum drying at 45° C. for 10 hours, and classified, thus obtaining a target non-uniformly shaped particle toner.) The volume average particle diameter of the toner was 8.5 μm.

The toner was examined by various tests as in the Example 6. The results indicated that no character memory occurred, and the anti-crush property and the moisture-proof property were good.

Example 10

As in the Example 6, the first colloidal oil drops having a particle diameter of 1.5 μm are formed.

The pH value of the solution containing the obtained colloidal oil drops was adjusted to 3.0, and the solution was stirred by the homogenizer at a stirring rate of 7000 rpm for 15 minutes, so as to carry out collision process. After that, the pH value of the mixture obtained was adjusted to 8.0, and the mixture was stirred at a stirring rate of 250 rpm. In the mixture, aggregated non-uniformly shaped particles each having a structure in which an about-1.5 μm-colloidal oil drop is aggregated on an about-9 μm-colloidal oil drop are observed. While setting the temperature of the mixture at 80° C., the mixture was subjected to polymerization using a polymerization initiator for 6 hours. After the polymerization, non-uniformly shaped polymers each having a shape in which a recess was formed on the surface of the substantially spherical particle were obtained. The polymer particles thus obtained were filtrated, washed, and dried. (After that, the polymers were subjected to vacuum drying at 45° C. for 10 hours, and classified, thus obtaining a target non-uniformly shaped particle toner.) The volume average particle diameter of the toner was 9.4 μm.

The toner was examined by various tests as in the Example 6. The results indicated that no character memory occurred, and the anti-crush property and the moisture-proof property were good.

Example 11

As in the Example 6, the first colloidal oil drops having a particle diameter of 1.5 μm are formed.

The pH value of the solution containing the obtained colloidal oil drops was adjusted to 5.0, and the solution was further stirred at a stirring rate of 700 rpm. In the mixture, aggregated non-uniformly shaped particles each having a structure in which an about-1.5 μm-colloidal oil drop is aggregated on an about-7 μm-colloidal oil drop are observed. while setting the temperature of the mixture at 90° C., the mixture was subjected to polymerization using a polymerization initiator for 5 hours. After the polymerization, non-uniformly shaped polymers each having a shape in which a projection was formed on the surface of the substantially spherical particle were obtained. The polymer particles thus obtained were filtrated, washed, and dried. (After that, the polymers were subjected to vacuum drying at 45° C. for 10 hours, and classified, thus obtaining a target non-uniformly shaped particle toner.) The volume average particle diameter of the toner was 7.5 μm.

The toner was examined by various tests as in the Example 6. The results indicated that no character memory occurred, and the anti-crush property and the moisture-proof property were good.

Example 12

As in the Example 6, the first colloidal oil drops having a particle diameter of 1.5 μm are formed.

The pH value of the solution containing the obtained colloidal oil drops was adjusted to 6.5, and the solution was further stirred at a stirring rate of 350 rpm. In the mixture, aggregated non-uniformly shaped particles each having a structure in which an about-1.5 μm-colloidal oil drop is aggregated on an about-10 μm-colloidal oil drop are observed. While setting the temperature of the mixture at 90° C., the mixture was subjected to polymerization using a polymerization initiator for 5 hours. After the polymerization, non-uniformly shaped polymers each having a shape in which a recess was formed on the surface of the substantially spherical particle were obtained. The polymer particles thus obtained were filtrated, washed, and dried. (After that, the polymers were subjected to vacuum drying at 45° C. for 10 hours, and classified, thus obtaining a target non-uniformly shaped particle toner.) The 50%-volume average particle diameter of the toner was about 9.8 μm.

The toner was examined by various tests as in the Example 6. The results indicated that no character memory occurred, and the anti-crush property and the moisture-proof property were good.

Controls corresponding to Examples 5 to 10 will be described.

Control Example 11

As in the Example 5, the first colloidal oil drops having a diameter of 2 μm were formed.

The pH value of the solution containing the obtained colloidal oil drops was adjusted to 7.0, and the colloidal oil drops were polymerized while stirring the solution at a stirring rate of 350 rpm. The polymerized particles, which serve as primary particles, are aggregated into secondary particles. The secondary particles were ripened at 98° C. for 1 hour, thus obtaining a non-uniformly-shaped particle toner. The volume average particle diameter of the toner particles was 10 μm. The toner was used as a developer as in the Example 5, and the image formation was carried out. After 20,000-running of image formation, the volume average particle diameter of the toner particles was changed to 9.0 μm, and the generation of fine particles was observed. It was further found that the image density was decreased. Further, the toner consumption amount was increased by 35% when the temperature and moisture were high.

Control Example 12

A toner was prepared in the same manner as in the Control 11 except that the ripening of the secondary particles were carried out for 3 hours. The toner was used as a developer, and the image formation was carried out. After the image formation, the generation of fine particles was observed. It was further found that the image density was decreased. Further, the toner consumption amount was increased by 35% when the temperature and moisture were high.

Regarding the Examples 5 to 10, Controls 11 to 20, the cleaning property, the anti-crush property, and the moisture-proof property were evaluated in the following manners. The results were as listed in Table 2.

Evaluation of Cleaning Property

By use of a commercially available copying machine (tradename: PDL600 of TOSHIBA), a developing operation was run on 20,000 sheets. The evaluation was based on whether or not the character memory occurs.

○ . . . no character memory occurred

X . . . character memory occurred

Evaluation of Anti-crush Property

Increase in amount of fine particles

By use of a commercially available copying machine (tradename: PDL600 of TOSHIBA), a developing operation was run on 20,000 sheets. After that, the diameters of the developer particles in the developing unit were measured by the coulter counter, and the measured values were compared with those obtained before the running of development. The evaluation was based on the increase in ratio of the developer particles having diameter of 2 μm or less.

○ . . . no change observed

X . . . the average diameter changed by 0.5 μm or more, or the ratio of the particles having diameters of 2 μm or less increased by 5% or more Evaluation of Image Density By use of a commercially available copying machine (tradename: PDL 600 of TOSHIBA), a developing operation was run on 20,000 sheets. After that the image density was measured by MACBETH R918 as an initial image density.

○ . . . lowering of image density: less than 0.25

X . . . lowering of image density: 0.25 or more

The following are examples of remodeled versions of the Examples 3 and 4 of the present invention, in which fine particles are actively utilized.

TABLE 2

| | | Anti-crush property | | |
|---|---|---|---|---|
| | Cleaning property | Amount increase of fine apairs | image density | Moisture-proof property |
| Example 5 | ○ | ○ | ○ | ○ |
| Example 6 | ○ | ○ | ○ | ○ |
| Example 7 | ○ | ○ | ○ | ○ |
| Example 8 | ○ | ○ | ○ | ○ |
| Example 11 | ○ | ○ | ○ | ○ |
| Example 12 | ○ | ○ | ○ | ○ |
| Control 11 | ○ | X | X | X |
| Control 12 | X | ○ | ○ | X |

Example 13

| Preparation of anion group resin emulsion | |
|---|---|
| Styrene | 160 parts |
| Butyl acrylate | 40 parts |
| Sodium dodecylbenzenesulfonate | 1 parts |
| Hydrogen peroxide | 5 parts |

The materials listed above were placed in a four-neck flask, and while stirring at a speed of 300 rpm, the emulsion polymerization. was carried out at 80° C. for 10 hours. Thus, a resin containing particles having a volume average particle diameter of 0.4 μm, each of which serving as the core of a colloidal oil drop was prepared.

Preparation of Monomer Mixture Solution 13A

A monomer mixture solution was prepared by mixing the materials listed below.

| | |
|---|---|
| Styrene-monomer | 60 parts |
| Butyl acrylate | 15 parts |
| Acrylic acid | 2 parts |
| Sodium dodecylbenzenesulfonate | 1 part |
| Benzoyl peroxide | 1 part |

Preparation of Dispersion Solution 13B

The materials listed below were dispersed by a ball mill and nannomizer, and there is obtained a dispersion solution 13B containing carbon particles adhered by a static attraction force on the surface of the resin particles having a volume average diameter of 0.4 μm.

| | |
|---|---|
| 20% anion-group resin emulsion | 30 parts |
| 10% cation carbon black dispersion solution | 40 parts |
| Water | 150 parts |

i) Preparation of First Colloidal Oil Drop

The dispersion liquid 13B and the mixture solution 13A were dispersed and mixed by the ball mill and the nannomizer, thus obtaining the first colloidal oil drops having a volume average particle diameter of 0.5 μm.

ii) Preparation of Second Colloidal Oil Drop-Collision Process of Colloidal Oil Drops 90 wt % of the solution containing the first colloidal solution was stirred by a homogenizer at 6000 rpm for 15 minutes, As the solution was stirred, colloidal oil drops collided with each other, thus obtaining a solution containing the second colloidal oil drops having a volume average particle diameter of 7 μm.

iii) Aggregation of First and Second Colloidal Oil Drops

The solutions containing the first and second colloidal oil drops were mixed together. The mixture solution was transferred into a four-neck flask. The pH value of the obtained mixture is adjusted to about 4.0 by sodium hydrogenphosphate, and the mixture was stirred at a stirring rate of 600 rpm for 30 minutes.

After stirring, a portion of the solution is sampled and observed under an optical microscope. Particles each having a structure in which 1 to 5 fine particle colloidal oil drops having diameters of 1 μm or less were irreversibly adhered to a colloidal oil drop having a particle diameter of 5 to 10 μm were found.

iv) Polymerization of Aggregated Colloidal Oil Drops

The aggregated colloidal oil drops obtained by the above aggregation step were polymerized in the following manner. That is, the temperature of the solution containing the drops was maintained at 70° C., and a polymerization initiator was added in the polymerization step. Then, the polymerization was carried out as the solution stirred for 8 hours. After the polymerization, non-uniformly shaped polymer particles each having substantially a spherical shape, the surface of which has a projection were formed. The polymer particles were filtrated and washed. After that, the obtained polymers were subjected to vacuum drying at 45° C. for 10 hours, thus obtaining the target non-uniformly shaped particle toner.

The toner obtained was a mixture of non-uniformly-shaped particles and fine particles having diameters of 1 μm or less. Regarding the 50%-volume average particle diameter, the toner had two peaks at 7.5 μm and 0.5 μm.

Further, the image output was conducted by use of the obtained toner as a developer. It was found that no cleaning error occurred even after 20,000 sheets of the image output.

Example 14

In the same manner as in the Example 13, the first and second colloidal oil drops were formed. The solutions each containing the respective colloidal oil drops were mixed together, and the mixture was stirred by a homogenizer at 6000 rpm for 20 minutes, so as to carry out the collision process of the colloidal oil drops. The pH value of the obtained mixture was adjusted to 7.0, and the mixture was stirred at a stirring rate of 300 rpm for 30 minutes. After stirring, a portion of the solution is sampled and observed under an optical microscope. Particles each having a structure in which fine particle colloidal oil drops having diameters of 1 μm or less were adhered to the second colloidal oil drop having a volume average particle diameter of 7 μm were found. The aggregated colloidal body have been made reversibly into the above-described state as adhesion and removal were repeated.

By setting the reaction temperature at 80° C., the aggregated bodies were polymerized in the polymerization step. The polymers obtained in the polymerization step were washed and dried as in the Example 11, thus obtaining a toner. The toner contained the first polymers of an average particle diameter of 7.0 μm, and the second polymers of an average diameter of 0.5 μm. The first polymers had substantially a spherical shape, on each of the surface of which a recess was formed by chemical bond. The second polymers had substantially a spherical shape which matches with the recess of the first polymers.

The image output was conducted by use of the obtained toner. It was found that no cleaning error occurred even after 30,000 sheets of the image output.

In the toners obtained in the Examples 13 and 14, the fine spherical polymers, which are created at the same time as the non-uniformly shaped polymers, serve as an additive for the polymers. With the fine spherical particles, the friction between the cleaning blade and the toner is increased, thereby further enhancing the cleaning property. Therefore, the clarification and addition steps can be omitted.

Examples 15 and 16

Resin containing particles each serving as a core of a colloidal oil drop, which has a volume average diameter of 0.04 μm, were prepared in the same manner as in Examples 13 and 14 except that 2 parts of sodium dodecylbenzenesulfonate was used in the preparation of the anion-group resin emulsion. Further, as in the Example 11, the first colloidal oil drops having a volume average particle diameter of 0.05 μm, and the second colloidal oil drops having a volume average particle diameter of 7 μm were obtained. After subjecting these oil drops to the aggregation and polymerization steps as in the Example 11, toner containing non-uniformly-shaped and surface-recessed polymers having a volume average particle diameter of 7.5 μm, and spherical polymer particles having a volume average particle diameter of 0.05 μm was obtained.

Also, these oil drops were subjected to the granulation and polymerization steps as in the Example 14, thus obtaining the toner containing non-uniformly-shaped and surface-recessed polymers having a volume average particle diameter of 7.0 μm, and spherical polymer particles having a volume average particle diameter of 0.05 μm. With the toners obtained, the development was conducted. Even after development of 30,000 sheets, a character memory did not occur.

Examples 17 and 18

Resin containing particles each serving as a core of a colloidal oil drop, which has a volume average diameter of 1.5 μm, were prepared in the same manner as in Examples 13 and 14 except that 4 parts of potassium persulfate was used in place of hydrogen peroxide in the preparation of the anion-group resin emulsion. Further, as in the Example 1, the first colloidal oil drops having a volume average particle diameter of 2 μm, and the second colloidal oil drops having a volume average particle diameter of 9 μm were obtained. After subjecting these oil drops to the granulation and polymerization steps as in the Example 11, obtained was a toner containing non-uniformly-shaped and surface-projecting polymers having a volume average particle diameter of 9.5 μm, and spherical polymer particles having a volume average particle diameter of 2 μm.

Also, these oil drops were subjected to the aggregation and polymerization steps as in the Example 14, thus obtaining the toner containing non-uniformly-shaped and surface-recessed polymers having a volume average particle diameter of 9.0 μm, and spherical polymer particles having a volume average particle diameter of 1 μm. With the toners obtained, development was conducted. Even after development of 30,000 sheets, a character memory did not occur.

Examples 19 and 20

A toner containing non-uniformly-shaped polymers, and fine particles having a average diameter of 0.5 μm was prepared in the same manner as in Examples 13 and 14 except that 95 wt % of the solution containing the first colloidal oil drops was used to prepare the second colloidal oil drops. With the toners obtained, development was conducted. Even after development of 30,000 sheets, a character memory did not occur.

The following are Comparative Examples in connection with the utilization of fine particles, which corresponds to Examples 13 to 20.

CONTROLS 13 and 14

Resin containing particles each serving as a core of a colloidal oil drop, which has a volume average diameter of 2 μm, were prepared in the same manner as in Examples 13 and 14 except that 6 parts of potassium persulfate was used in place of hydrogen peroxide in the preparation of the anion-group resin emulsion. Further, as in the Example 11, the first colloidal oil drops having a volume average particle diameter of 2.5 μm, and the second colloidal oil drops having a volume average particle diameter of 9.5 μm were obtained. After subjecting these oil drops to the aggregation and polymerization steps as in the Example 13, a toner containing non-uniformly-shaped and surface-projecting polymers having a volume average particle diameter of 10 μm, and spherical polymer particles having a volume average particle diameter of 2.5 μm was obtained.

Also, these oil drops were subjected to the granulation and polymerization steps as in the Example 14, thus obtaining the toner containing non-uniformly-shaped and surface-recessed polymers having a volume average particle diameter of 9.5 μm, and spherical polymer particles having a volume average particle diameter of 2.5 μm. With the toners obtained, the development was conducted. After development of 500 sheets, a character memory occurred.

In addition, the toners obtained in Controls 13 and 14 were subjected to a classification step for separating the non-uniformly-shaped particles out. With the classified toner, no character memory occurred even after 20,000 running of development.

CONTROLS 15 and 16

A toner containing non-uniformly-shaped polymers having an average diameter of 7.0 μm, and fine particles having an average diameter of 0.5 μm was prepared in the same manner as in Examples 13 and 14 except that 85 wt % of the solution containing the first colloidal oil drops was used to prepare the second colloidal oil drops. With the toners obtained, the development was conducted, and a character memory occurred after 800-running of development.

CONTROLS 17 and 18

Resin containing particles each serving as a core of a colloidal oil drop, which has a volume average diameter of 0.02 μm, were prepared in the same manner as in Examples 13 and 14 except that 3 parts of sodium dodecylbenzenesulfonate was used in the preparation of the anion-group resin emulsion. Further, as in the Example 11, the first colloidal oil drops having a volume average particle diameter of 0.03 μm, and the second colloidal oil drops having a volume average particle diameter of 7 μm were obtained. After subjecting these oil drops to the aggregation and polymerization steps as in the Examples 13 and 14, a toner containing non-uniformly-shaped polymers, and spherical polymer particles having a volume average particle diameter of 0.03 μm was obtained. With the toner obtained, the development was conducted. After development of 500 sheets, a character memory occurred.

CONTROLS 19 and 20

A toner containing non-uniformly shaped polymer particles and fine particles having a volume average diameter of 0.5 μm, was prepared in the same manner as in Examples 19 and 20 except that 99.8wt % of the solution containing the first colloidal oil drops was used to prepare the second colloidal oil drops. With the toner obtained, development was conducted, and after 500-running of development, a character memory occurred.

As can be concluded from the results of Examples 13 to 20, and Controls 11 to 20, the diameter of the first colloidal oil drops should preferably be in a range of 0.05 μm to 2 μm. If the particle diameter is less than 0.05 μm, the effect for enhancing the frictional force of the toner is insufficient, and the improvement of the cleaning property cannot be expected. In contrast, if the diameter is larger than 2 μm, the first colloidal drops are separated from the toner, and tend to remain between the drum and the blade. Consequently, the stuck first colloidal oil drops help the non-uniformly shaped toner particles, originated from the second colloidal oil drops, easily pass between the drum and blade. As a result, it is considered that the cleaning property rather decreases.

Further, the results of the Examples 13 to 20 and Controls 11 to 20 show that the mixture ratio of the first colloidal oil drops should be 0.5 to 10 wt %. If the mixture ratio is less than 0.5 wt %, the particles cannot be non-uniformly shaped in the production method of the present invention, resulting in cleaning error. If the ratio exceeds 10 wt %, some of the first colloidal drops remain between the drum and the blade, and these stuck first colloidal oil drops help the non-uniformly shaped toner particles, originated from the second colloidal oil drops, easily pass between the drum and blade. As a result, it is considered that the cleaning property rather decreases.

FIG. 3 shows the results of the evaluations of Examples 13 to 20 and Controls 11 to 20 in terms of cleaning property, anti-crush property, and moisture-proof property. The evaluation of the cleaning property was based on the following manner. Those without character memory even after 30,000-running of development were marked as ⊙, those without character memory even after 20,000-running of development were marked as ○, and those having character memory after 20,000-running were marked as X.

Additional advantages and modifications will readily occur to those skilled in the art. Therefore, the invention in its broader aspects is not limited to the specific details, representative materials, and illustrated examples shown and described herein. Accordingly, various modifications may be made without departing from the spirit or scope of the general inventive concept as defined by the appended claims and their equivalents.

TABLE 3

| | Diameter of first colloidal oil drop | Mixture ratio of first colloidal oil drop | Diameter of second colloidal oil drop | Cleaning property |
|---|---|---|---|---|
| Example 13 | 0.5 μm | 10 | 7.0 μm | ⊙ |
| Example 14 | 0.5 μm | 10 | 7.0 μm | ⊙ |
| Example 15 | 0.05 μm | 10 | 7.0 μm | ⊙ |
| Example 16 | 0.05 μm | 10 | 7.0 μm | ⊙ |
| Example 17 | 2.0 μm | 10 | 9.0 μm | ⊙ |
| Example 18 | 2.0 μm | 10 | 9.0 μm | ⊙ |
| Example 19 | 0.5 μm | 0.1 | 7.0 μm | ⊙ |
| Example 20 | 0.5 μm | 0.1 | 7.0 μm | ⊙ |
| Control 13 | 2.5 μm | 10 | 9.5 μm | X |
| Control 14 | 2.5 μm | 10 | 9.5 μm | X |
| (Classified) Control 13 | 2.5 μm | 10 | 9.5 μm | ○ |
| (Classified) Control 14 | 2.5 μm | 10 | 9.5 μm | ○ |
| Control 15 | 0.5 μm | 15 | 7.0 μm | X |
| Control 16 | 0.5 μm | 15 | 7.0 μm | X |
| Control 17 | 0.03 μm | 10 | 7.0 μm | X |
| Control 18 | 0.03 μm | 10 | 7.0 μm | X |
| Control 19 | 0.5 μm | 0.05 | 7.0 μm | X |
| Control 20 | 0.5 μm | 0.05 | 7.0 μm | X |

What is claimed is:

1. A developing agent comprising:

a non-uniformly-shaped polymerized particle obtained by polymerizing a plurality of aggregated colloidal oil drops whereby said drops are chemically bonded together, wherein each of said oil drops comprises:

a developing agent core comprising a polymerized spherical resin and a coloring agent adhered to said resin by electrostatic force, and a mixture of monomers swelling said developing agent core.

2. A developing agent according to claim 1, wherein said polymerized particle is obtained through a process selected from the group consisting of emulsification polymerization and suspension polymerization.

3. A developing agent according to claim 1, wherein the resin particle has a volume average particle diameter of 0.04 to 0.4 μm.

4. A developing agent according to claim 1, wherein said developing agent has a volume average particle diameter of 0.5 to 10 μm.

5. A developing agent according to claim 1, wherein said colloidal oil drops have a volume average particle diameter of 0.5 to 2 μm.

6. A developing agent according to claim 1, wherein the volume average particle diameter of said coloring agent is from about 0.001 μm to about 0.1 μm.

7. A developing agent according to claim 4, wherein said developing agent has a volume average particle diameter of about 3 μm to about 6 μm.

* * * * *